US006739805B2

(12) United States Patent
Shotton

(10) Patent No.: US 6,739,805 B2
(45) Date of Patent: May 25, 2004

(54) WATERSTOP FOR FOUNDATION ELEMENTS AND METHOD OF INSTALLATION

(75) Inventor: Peter Gilbert Shotton, Buckinghamshire (GB)

(73) Assignee: Cementation Foundations Skanska Limited, Herts (GB)

( * ) Notice: Subject to any disclaimer, the term of this patent is extended or adjusted under 35 U.S.C. 154(b) by 0 days.

(21) Appl. No.: 10/045,025

(22) Filed: Jan. 15, 2002

(65) Prior Publication Data

US 2002/0119013 A1 Aug. 29, 2002

(30) Foreign Application Priority Data

Jan. 15, 2001 (GB) ..... 0101017

(51) Int. Cl.[7] ..... E04F 15/14; E04B 1/686; E02D 5/18

(52) U.S. Cl. ..... 405/267; 405/266; 405/268; 405/287; 52/127.3; 52/396.02; 52/687; 404/48; 404/64

(58) Field of Search ..... 405/109, 266, 405/268, 270, 267; 52/127.3, 169.9, 396.02, 396.04, 573.1, 687, 688; 404/48, 49, 64, 65, 67, 69

(56) References Cited

U.S. PATENT DOCUMENTS

| | | | | |
|---|---|---|---|---|
| 3,796,064 A | * | 3/1974 | Piccagli | 405/267 |
| 4,041,665 A | | 8/1977 | De Munck | |
| 4,582,453 A | | 4/1986 | Ressi di Cervia | |
| 5,022,792 A | * | 6/1991 | Konno et al. | 405/267 |
| 6,007,615 A | * | 12/1999 | Kato et al. | 106/284.02 |
| 6,276,106 B1 | * | 8/2001 | Shotton et al. | 52/396.02 |

FOREIGN PATENT DOCUMENTS

| | | | | |
|---|---|---|---|---|
| EP | 0 101 350 | | 2/1984 | |
| EP | 304415 | * | 2/1989 | 405/267 |
| EP | 0 402 247 | | 12/1990 | |
| EP | 756043 | * | 1/1997 | |
| EP | 1223248 | * | 12/2001 | |
| FR | 2590915 | * | 6/1987 | |
| GB | 2264739 | * | 9/1993 | |
| GB | 2 325 262 A | | 11/1998 | |
| JP | 61233115 | * | 10/1986 | 405/267 |
| JP | 62160311 | * | 7/1987 | 405/267 |
| JP | 63304831 | * | 12/1988 | 405/267 |
| JP | 05222351 | * | 8/1993 | 525/127 |
| JP | 05331844 | * | 12/1993 | 405/132 |

* cited by examiner

*Primary Examiner*—Jong-Suk (James) Lee
(74) *Attorney, Agent, or Firm*—Browdy and Neimark

(57) ABSTRACT

A waterstop, 10 or 11, for restricting or preventing the flow of water across the joints of foundation elements 8, such as between or along individual diaphragm wall panels or between or along individual secant wall piles. The present invention also relates to a method of installing a waterstop at or near the joints between adjacent foundation elements. The waterstop consists of one or more longitudinal strips, 1 or 2, of hydrophilic material, wherein the or each hydrophilic strip extends vertically along the interface between adjacent foundation elements, from a position at or near the top of the foundation elements, to a position at or near the base of the elements.

18 Claims, 5 Drawing Sheets

WATERSTOP FOR FOUNDATION ELEMENTS AND METHOD OF INSTALLATION

BACKGROUND OF THE INVENTION

1. Technical Field of the Invention

The present invention relates to an apparatus for restricting or preventing the flow of water across the joints of foundation elements, such as between or along individual diaphragm wall panels or between or along individual secant wall piles. The present invention also relates to a method of installing a waterstop at or near the joints between adjacent foundation elements.

2. Prior Art

A diaphragm wall is made by casting a series of concrete panels, which may be reinforced, in excavated trenches as described, for example, in EP 0 101 350 and EP 0 402 247. In some cases, alternate 'primary' panels are constructed first, followed by infill (i.e. closing) 'secondary' panels. The installation sequence would be, for example, panels 1, 3, 5, 7, 9, 11 etc. followed by panels 2, 4, 6, 8, 10 etc. In other cases, only a few 'primary' panels are first constructed, for example panels 1, 10 and 20. Following this, a series of 'continuity' panels 2, 11, 3, 12 etc. are installed, with the diaphragm wall being completed by 'closing' panels 9 and 19. All primary panels require the use of shutters at each edge of their respective trenches in order to provide well-defined edges to each panel so as to ensure that the joins between adjacent panels may be made watertight. Continuity panels, in contrast, require only one shutter at the edge of the trench furthest away from the previously cast panel. No shutters are required for closing panels. The shutters are conventionally known as 'stop-ends', and provide the concrete at each vertical edge of the panels with a predetermined shape.

In order to reduce water leakage across the joints between panels, it is possible to install a waterbar between adjacent panels with particular types of stop end as described in EP0101350. A waterbar comprises a strip of suitable material, for example rubber or PVC, which has one longitudinal edge embedded in the edge of one cast panel and the other longitudinal edge embedded in the adjacent panel. Preferably, the waterbar extends over substantially the entire height of the diaphragm wall. Such a waterbar may be installed by employing a stop-end provided with a slot in its face into which the waterbar may be fitted, with about one half of its width remaining exposed. When concrete is poured into the trench on this side of the stop-end and allowed to set, the stop-end may subsequently be removed so as to leave approximately half the waterbar embedded in the resulting concrete panel. When the next panel is cast, the remaining exposed portion of the waterbar will become embedded in concrete, thereby resulting in a seal between the two adjacent panels. Typical waterbars have beaded longitudinal edges, giving the waterbar a dumb-bell shaped cross-section, with an optional central bulb.

As is well-known, concrete does not bond well to rubber or PVC; therefore, loss of intimate contact can occur between the concrete foundation element and the waterbar. There is therefore a risk that water will leak through the joint. The loss of intimate contact may be a result of the way in which the foundation element and waterbar were installed or it may be due to the relative movement of adjacent elements.

In United Kingdom patent application 2325262, a two-part hydrophilic waterbar was demonstrated. If the hydrophilic element becomes wetted, as a result of water leaking through the joint, the hydrophilic material swells, thereby forming a seal between the two adjacent members.

There are a number of limitations/problems associated with known waterbar systems. For example, all of the known types of waterbars require the use of a stop-end to facilitate the installation of the waterbar. However, in some underground structures it may not always be possible or desirable to use stop-ends between adjacent elements. In these cases a waterbar can not be installed and so if the installation of a waterbar is required, the choice of construction of the diaphragm wall panels is restricted. For example, diaphragm walls can be excavated by means of "hydromills". A hydromill is an apparatus for drilling into the ground and is equipped at the base with one or more pairs of contra-rotating drums. The drums cut the soil which is then excavated from the base by hydraulic means, such as by the circulation of drilling muds. Usually, when constructing diaphragm walls using this apparatus, a series of primary and secondary panels are formed wherein the second panels "cut back" into the vertical edge of the primary panels. Stop-ends are not normally used, in which case it is not possible to install a waterbar.

Furthermore, underground structures such as secant pile walls, which comprise a series of primary (conventionally called "female") and secondary (conventionally called "male") piles to not involve the use of stop-ends. Pile construction can be by a variety of methods such as oscillated casing with rotary rig or grab, CFA methods or rotary boring without casing. At present there are no suitable apparatus which can be installed for restricting the flow of water along or across the vertical joints in secant pile walls.

Another limitation suffered by the known waterbar systems, is that although the waterbar will substantially prevent the flow of water horizontally across the joint between adjacent elements, water can still rise up the joint in a vertical direction between the two panels. In order to demonstrate this consider: a peripheral diaphragm wall which is installed in soil strata, where the lower end of the diaphragm wall is situated in water-bearing strata. Assume that a vertical waterbar has been effectively installed across the joints between adjacent panels, at or near the centre of the wall thickness, and that it extends to the base of the diaphragm wall.

After the wall has been exposed (e.g. for a basement) the vertical waterbar will prevent movement of water horizontally, from behind the diaphragm wall through to the exposed face. However, there is a potential for water to rise up the joint between two panels in the zone between the exposed face and the waterbar.

Object and Summary of the Invention

The present invention seeks to mitigate the aforementioned limitations and provides a waterstop, and a method of installing the same, which serves to resist the flow of water along or across the joints between adjacent foundation elements. The waterstop of the present invention does not depend upon the provision of a stop-end for its installation, and can therefore be advantageously employed in subterranean constructions such as secant pile walls and diaphragm walls, including those excavated by means of hydromills. It should however be appreciated that in many cases the elements will still be provided with stop-ends in order to provide the concrete at each vertical edge with a predetermined shape.

The installation of a waterstop according to the present invention is particularly appropriate for "open bore" operations in which the soil is excavated and the resultant hole is then filled with concrete or grout.

According to one aspect of the present invention, there is provided a waterstop for resisting the flow of water along the interface between two adjacent foundation elements, the waterstop comprising one or more longitudinal strips of hydrophilic material, characterised in that the waterstop forms an integral part of one of the adjacent foundation elements and wherein the hydrophilic strips extend vertically from a position at or near the top of the foundation element to a position at or near the base of the element.

The strip(s) of hydrophilic material are preferably supported by one or a number of support elements. The support element(s) may be advantageously made from a geotextile material which may or may not exhibit hydrophilic properties. However, any other suitable material can be used including a sheet of supporting material.

An important aspect of the waterstop of the present invention is that the waterstop preferably forms an integral part of the foundation element into which it is installed. Unlike known systems, the waterstop does not span across the joint and into both of the adjacent elements. As such, the waterstop does not require the provision of a stop-end to facilitate the installation.

According to a second aspect of the present invention, there is provided a method of installing a waterstop for resisting the flow of water along and/or between adjacent foundation elements, the method comprising the steps of:

i) constructing a series of primary foundation elements at a number of predetermined positions in the ground;

ii) excavating a bore in the ground adjacent to one of the primary foundation elements;

iii) lowering a waterstop comprising one or a number of longitudinal strip(s) of hydrophilic material into the bore, such that the strips extend vertically from a position at or near the top of the bore to a position at or near the base of the bore; and iv) pumping concrete or grout into the bore so as to form a secondary foundation element, wherein the waterstop forms an integral part of the resulting secondary foundation element.

Advantageously, when the concrete or grout is pumped into the base, the arrangement is such that, as the concrete or grout fills the bore, the strips of hydrophilic material of the waterstop are pushed towards the adjacent panel.

The flow of concrete as it is poured into the bore, naturally serves to push the waterstop towards the primary panel. In addition, a rolling means may advantageously be provided at the lower end of the waterstop, between the hydrophilic strip(s) and the support element. The rolling means preferably comprises a roller or wheel which is connected about it central axis to a lever. The lever is connected to the support element such that, the lever pivots about the support element under the weight of the concrete or by some other means, thereby causing the roller to push against the hydrophilic strip. The strip is then pushed towards the adjacent existing concrete edge.

According to a third aspect of the present invention, there is provided a foundation element having a waterstop formed therein, wherein the waterstop comprises one or more longitudinal strips of hydrophilic material, wherein the hydrophilic strips extend vertically from a position at or near the top of the foundation element to a position at or near the base of the element.

The waterstop of the present invention is conveniently installed in the secondary elements after the formation of the primary elements. For example, in the case of a diaphragm wall, a series of alternate "primary" panels are constructed, and the region between each pair of primary elements is excavated. One or more waterstops can then be advantageously lowered into either side of the excavated hole near the adjacent primary panels. Concrete is then pumped into the excavated hole to form the so-called "secondary" panel. As the concrete enters the excavated hole and begins to fill it, the strips of material of the waterstop are pushed by the concrete towards the adjacent panel. Alternatively, one or a few "primary" element(s) may be constructed and the second, third, forth etc elements are formed consecutively in turn. In this case, only the side of the foundation element which is adjacent the pre-formed concrete element will be provided with a waterstop.

The same techniques can advantageously be applied to all open bore constructions, such as secant piled walls, wherein a series of primary elements are installed followed by a number of secondary elements which are advantageously provided with a waterstop of the present invention.

In order to prevent the flow of water in a vertical fashion between adjacent foundation elements, there may advantageously be provided one or a pair of supplementary elements which extend orthogonally from the longitudinal axis of the waterstop element. These elements are preferably positioned at a predetermined level either side of the waterstop element and serve to resist and/or absorb water that rises in a vertical fashion up the waterstop. The supplementary elements are preferably chevron or wedge shape and are affixed to the waterstop such that one edge runs parallel to the edge of the waterstop and the other side extends from an apex near the lower end of the waterstop. This shape is particularly beneficial since as concrete enters the bore from the bottom and rises up the sides of the waterstop, the supplementary elements are encouraged towards the hydrophilic strips of material. Furthermore, any water that rises from below will come into contact with the supplementary elements and be blocked and/or absorbed. The supplementary elements are preferably provided with one or more strips of hydrophilic material.

BRIEF DESCRIPTION OF THE DRAWINGS

For a better understanding of the present invention, and to show how the same may be carried into effect, reference will now be made by way of example to the accompanying drawings in which.

DETAILED DESCRIPTION OF THE PREFERRED EMBODIMENT(S) OF THE INVENTION

Figure 1:
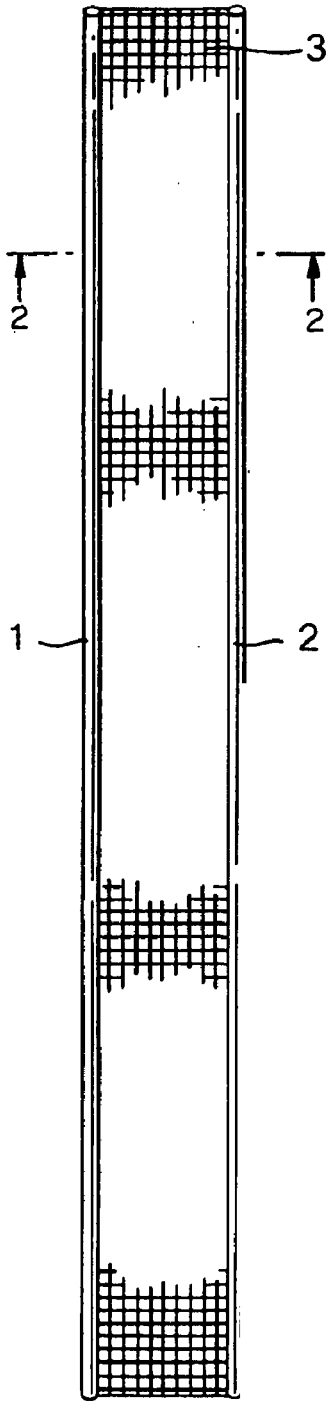
FIG. 1 shows a waterstop of the present invention.
Figure 2:
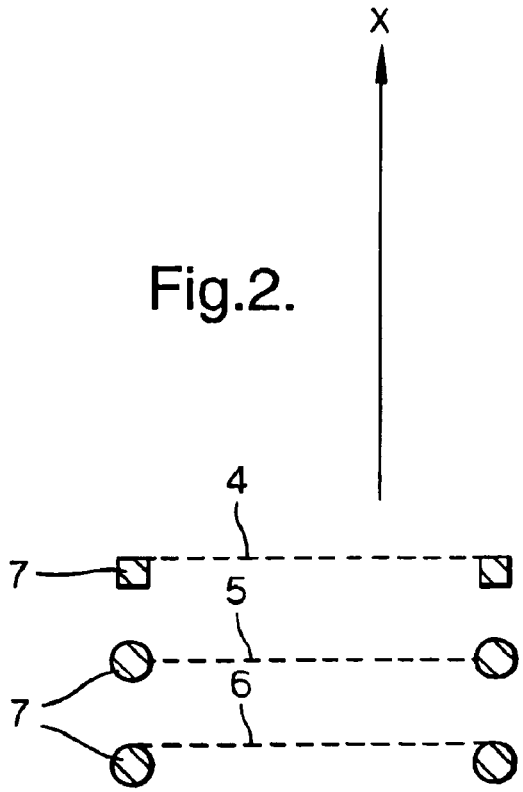
FIG. 2 shows a sectional view through 2—2 of FIG. 1.

FIG. 1 shows a waterstop of the present invention comprising two longitudinal hydrophilic cords 1 and 2, which are separated and supported by a support element 3 which is made of geotextile or any other suitable material. A section 2—2 through FIG. 1 is shown in FIG. 2 and comprises a series of waterstop members 4, 5 and 6 which are substantially parallel to each other. By way of illustration, the cross-sectional shape of the hydrophilic cords 7 are shown to be either square or circular. It should be appreciated that the cross section of the hydrophilic cords is not critical and that many alternative shapes are envisaged. Furthermore, the point of attachment of the support to the cords is not critical.

Figure 3A:
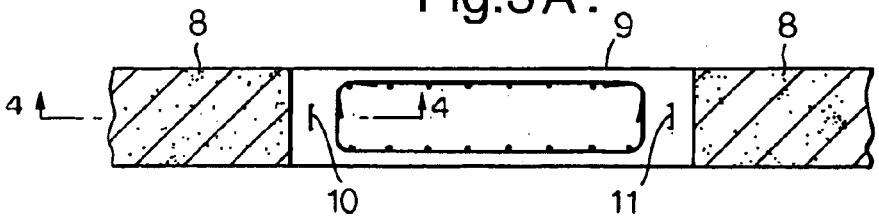
FIG. 3 shows a plan view of a series of diaphragm wall panels.
Figure 3B:
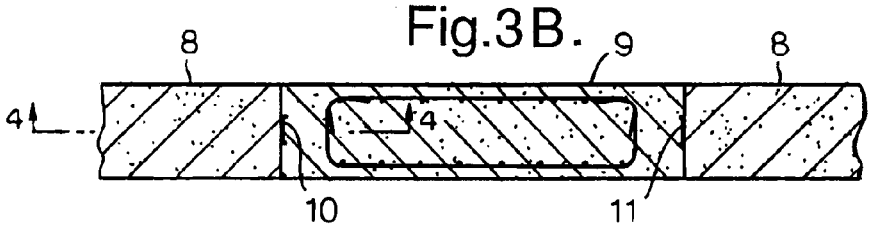

FIG. 3 shows a plan view of a series of diaphragm wall panels comprising alternate "primary" panels 8, and an excavated bore 9, for a secondary panel. FIG. 3A illustrates the position of two waterstops 10 and 11 in the excavated bore. Each waterstop is lowered into the bore at a position near the adjacent primary panel. FIG. 3B shows the position of the waterstops 10 and 11 after concrete or grout has been poured into the excavated bore. The waterstops will have been pushed by the concrete and/or by a rolling means towards the adjacent panel and the longitudinal hydrophilic cords, will extend vertically from the top of the panel 9, to a position at or near the base of the panel.

Figure 4A:
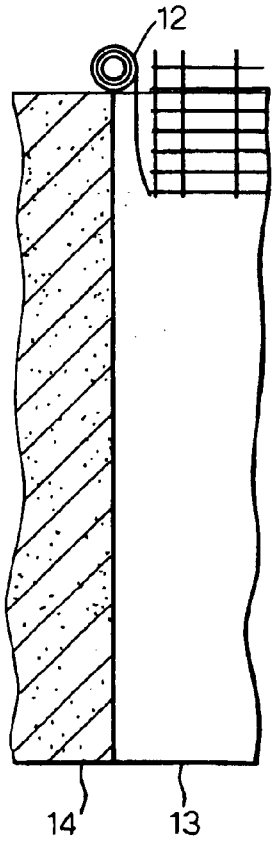
FIG. 4 shows an elevational view through section 4—4 of FIG. 3 and illustrates the lowering of the waterstop in an excavated bore.
Figure 4B:
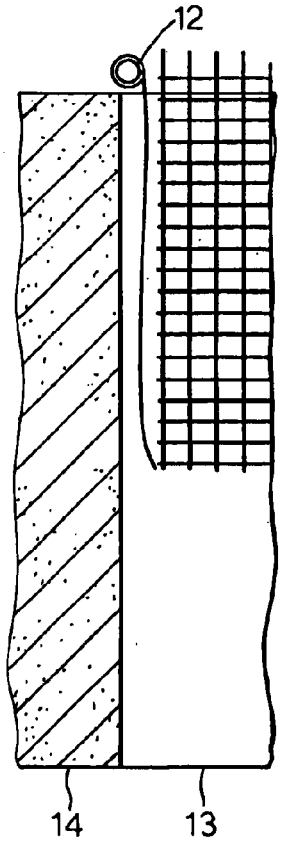
Figure 4C:
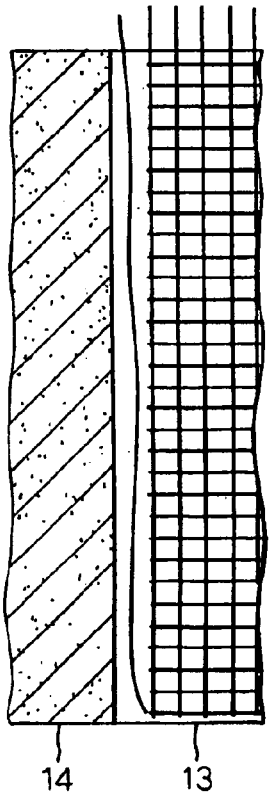
Figure 5C:
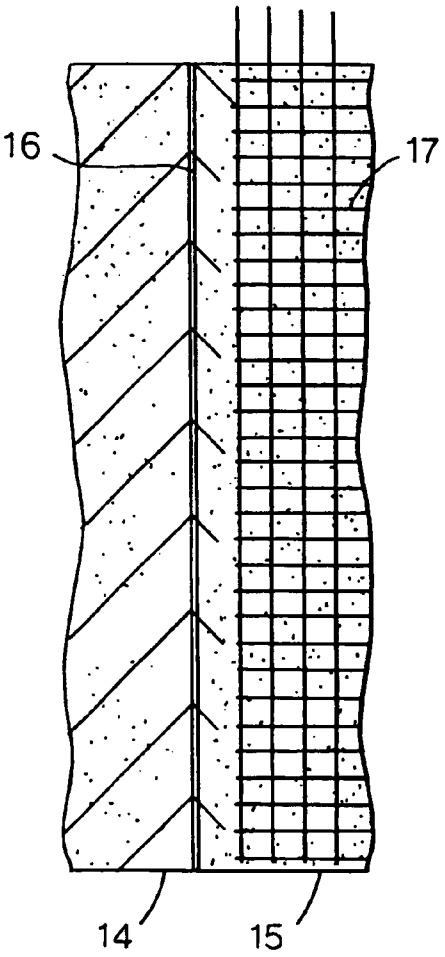
FIG. 5 illustrates the motion of the waterstop as concrete or grout is pumped into the excavated bore.
Figure 5B:
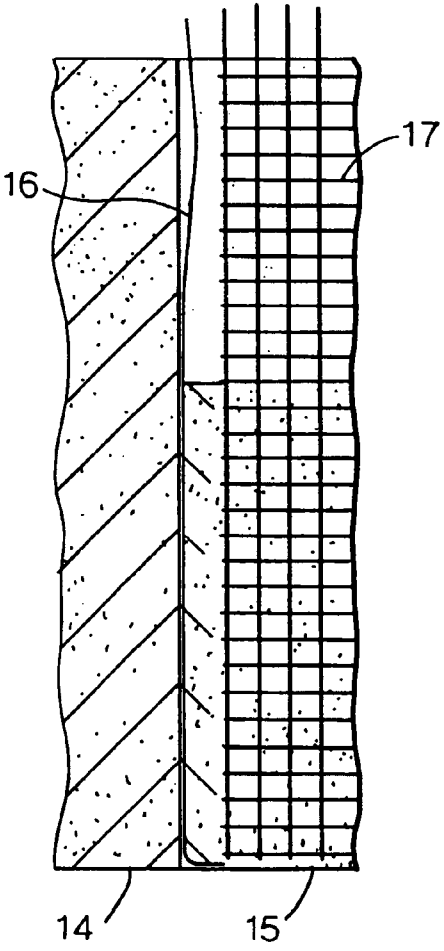
Figure 5A:
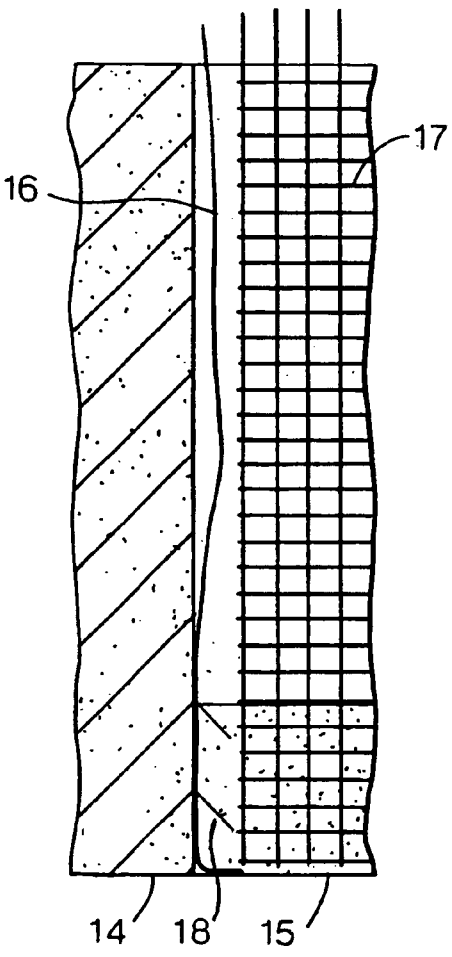

The installation of a waterstop of the present invention, into a foundation element, is illustrated in FIGS. 4 and 5. FIG. 4 shows a waterstop according to the present invention being lowered from a coil 12 into the bore 13 adjacent to the primary panel 14. In FIG. 4C, the waterstop has been fully lowered into the bore. FIG. 5 illustrates the motion of the hydrophilic material 16 towards the primary panel 14 as concrete or grout is pumped into the bore. As the level of the concrete rises, the hydrophilic strip 16 and, is pushed against the primary panel thereby acting as a seal between the two diaphragm wall panels.

Figure 6:
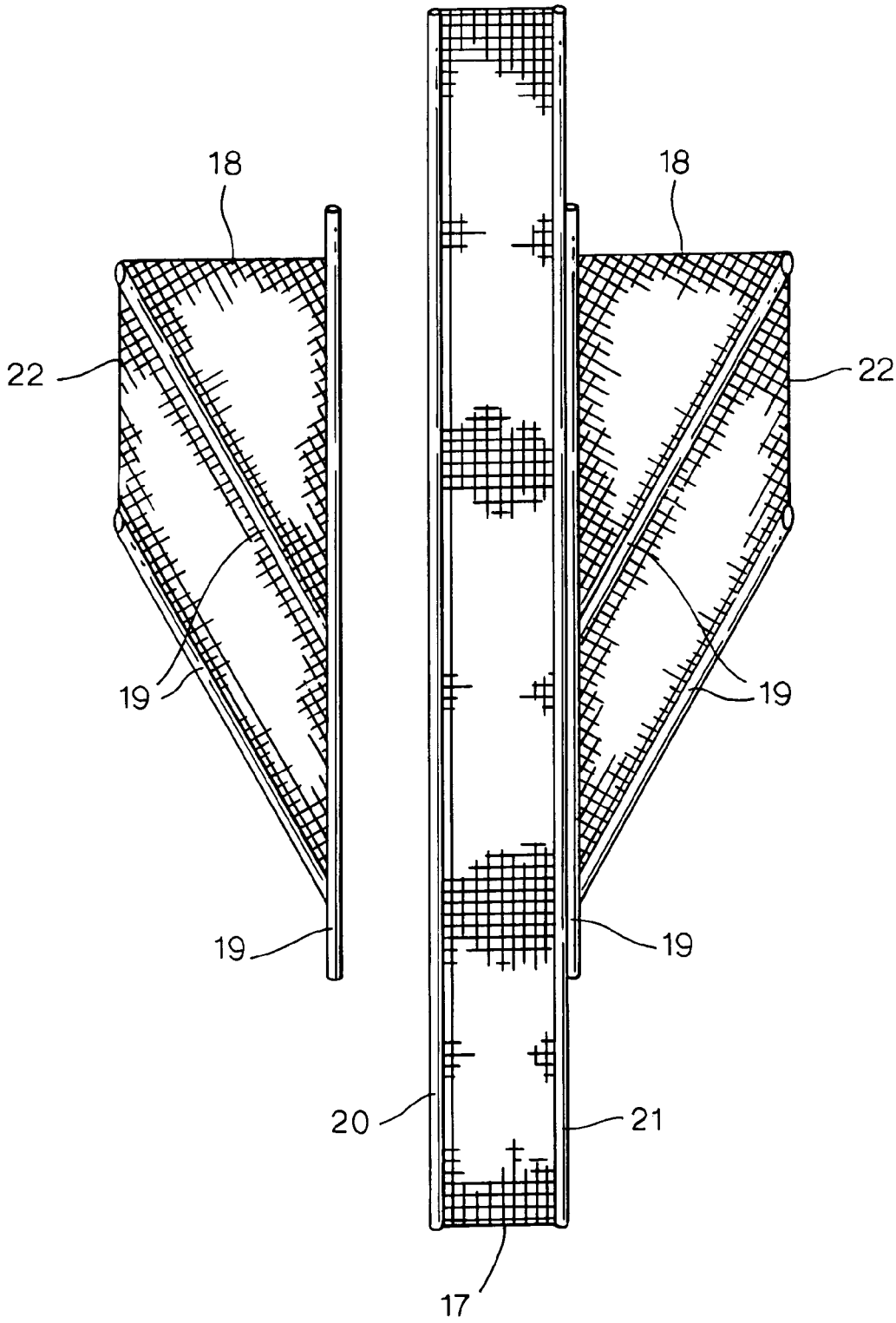
FIG. 6 illustrates a waterstop having two supplementary element.

A further waterstop according to the present invention is shown in FIG. 6. The Figure shows two longitudinal hydrophilic cords 20 and 21 which are supported by a geotextile support frame 17. A supplementary element 18 is provided either side of the two longitudinal hydrophilic cords which extends orthogonally therefrom. The elements comprise a number of hydrophilic cords 19 supported by a geotextile support frame 22 and are chevron or wedge shaped. In use, they are positioned at a predetermined level with respect to the bore. They serve to resist and/or absorb water that may rise in a vertical fashion between the adjacent panels either side of the longitudinal strips of hydrophilic material, and are affixed to the waterstop such that one edge runs parallel to the edge of the hydrophilic cord and the other side extends from an apex near the lower end of the waterstop. As concrete enters the bore from the bottom and rises up the sides of the waterstop, the supplementary elements are encouraged towards the hydrophilic strips of material 20 and 21. Furthermore, any water that rises from below will come into contact with the supplementary elements and be blocked and/or absorbed.

Figure 7B:
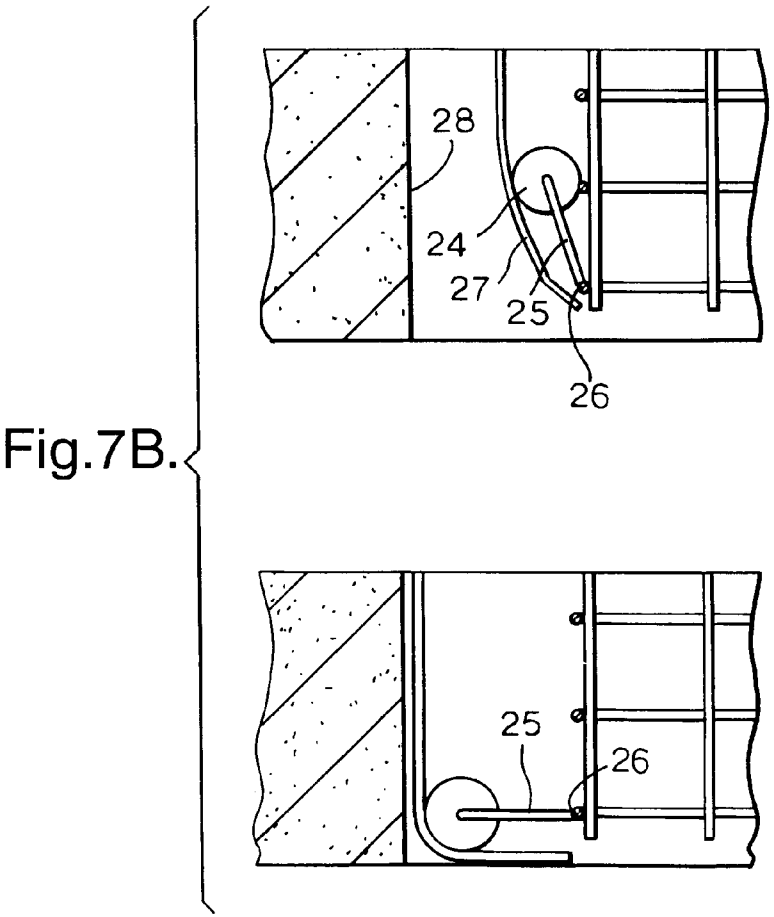
FIG. 7 shows a waterstop having a rolling means.
Figure 7A:
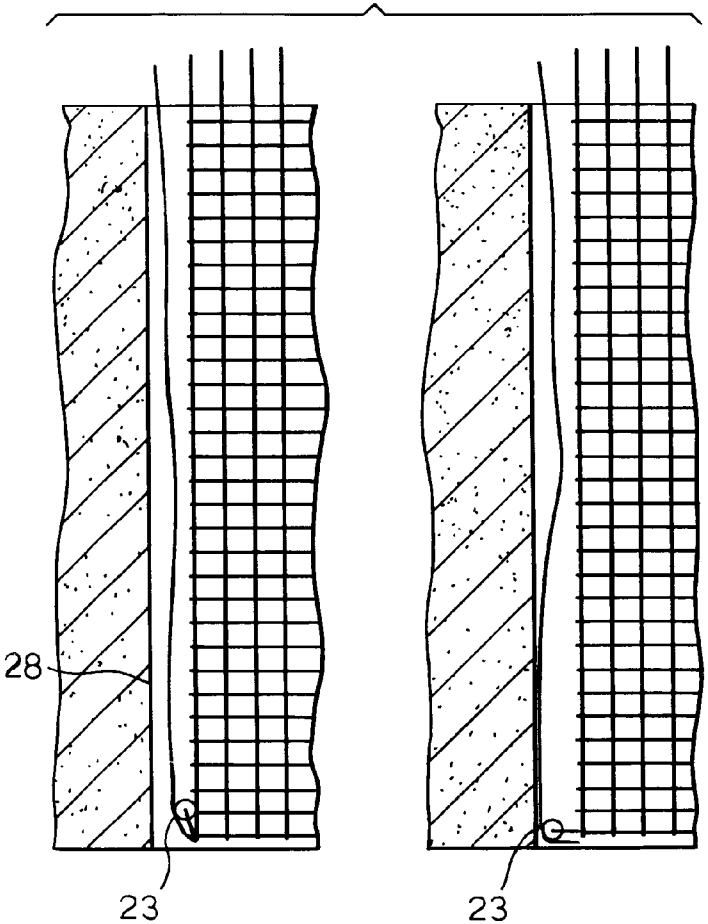

FIG. 7 illustrates a waterstop of the present invention having a rolling means 23 at the lower end thereof, between the hydrophilic strip 27 and the support element 26. The rolling means comprises a roller or wheel 24 which is connected at its central axis to a lever 25. The lever is connected to the support element 26 such that it can be pivoted, either under the weight of the concrete or by some other means, about the point of attachment to the support element thereby causing the roller to push against the hydrophilic strip 27. In turn, the strip is pushed away from the support element and towards the existing concrete edge 28.

While all of the examples illustrated herein have related to the installation of a waterstops in a diaphragm wall, it should be appreciated that the present invention can be applied to any foundation structures which involve a series of constituent elements such as a secant pile wall.

What is claimed is:

1. A method of installing a waterstop for resisting the flow of water along the interface between adjacent foundation elements, the method comprising the steps of:

i) constructing one or a series of primary foundation elements at predetermined positions in the ground;

ii) excavating a bore in the ground adjacent to the or each of the primary foundation elements;

iii) lowering a waterstop comprising one or a number of longitudinal strips of hydrophilic material into the bore, such that the or each strip extends vertically from a position at or near the top of the bore to a position at or near the base of the bore;

iv) pumping or placing concrete or grout into the bore so as to form a secondary foundation element, wherein as the concrete or grout enters the bore, the or each longitudinal strip of hydrophilic material is pushed towards the adjacent primary foundation element such that when the secondary foundation element is formed, the or each strip of hydrophilic material extends vertically along the interface between the primary and secondary elements and does not span across the interface into both foundation elements; and v) installing at least one supplementary element at a position adjacent to one of the at least one longitudinal strips of hydrophilic material, wherein the or each supplementary element extends in an orthogonal direction with respect to the longitudinal axis of the, or each, longitudinal strip of hydrophilic material and which, in use, serves to resist and/or absorb water which rises in a vertical fashion along the interface between adjacent foundation elements.

2. A method as claimed in claim 1, wherein the or each longitudinal strip of hydrophilic material is supported by at least one support element.

3. A method as claimed in claim 2, wherein the or each support element is made from a reticulated material.

4. A method as claimed in claim 2, wherein the or each support element is made from a geotextile material.

5. A method as claimed in claim 1, wherein the waterstop comprises two longitudinal strips of hydrophilic material and a support element, wherein the support element extends between the longitudinal strips substantially along the length thereof.

6. A method as claimed in claim 1, wherein the cross section of the hydrophilic material is substantially circular in shape.

7. A method as claimed in claim 1, wherein the cross section of the hydrophilic material is substantially square or rectangular in shape.

8. A method as claimed in claim 1, wherein the supplementary element is provided with at least one strip of hydrophilic material and serves to resist and/or absorb the flow of water which rises in a vertical fashion along the interface between adjacent foundation elements.

9. A method as claimed in claim 1, wherein the or each supplementary element is substantially wedge shaped, and wherein one side of the or each supplementary element extends parallel to the or one of the longitudinal strips of hydrophilic material and the other side extends from an apex near the lower end of said longitudinal strip.

10. A waterstop for resisting the flow of water along an interface between two adjacent foundation elements, the waterstop comprising one or more longitudinal strips of hydrophilic material, wherein, in use, the hydrophilic material extends vertically along the interface between adjacent foundation elements, from a position at or near the top of the foundation elements, to a position at or near the base of the elements and does not span across the interface into both of the adjacent elements, the waterstop further comprising one or more supplementary elements which extend in an orthogonal direction with respect to the longitudinal axis of the, or each, longitudinal strip of hydrophilic material, wherein the or each supplementary element(s) comprises hydrophilic material such that, in use, serves to resist and/or absorb water which rises in a vertical fashion along the interface between adjacent foundation elements.

11. A waterstop as claimed in claim 10, wherein said waterstop forms an integral part of one of the foundation elements.

12. A waterstop as claimed in claim 10, wherein the or each longitudinal strip of hydrophilic material is supported by at least one support element.

13. A waterstop as claimed in claim 12, wherein the or each support element is made from a reticulated material.

14. A waterstop as claimed in claim 12, wherein the or each support element is made from a geotextile material.

15. A waterstop as claimed in claim 10, comprising two longitudinal strips of hydrophilic material and a support element, wherein the support element extends between the longitudinal strips substantially along the length thereof.

16. A waterstop as claimed in claim 10, wherein the cross section of the hydrophilic material is substantially circular in shape.

17. A waterstop as claimed in claim 10, wherein the cross section of the hydrophilic material is substantially square or rectangular in shape.

18. A waterstop as claimed in claim 10, further comprising at least one supplementary element positioned adjacent to one of the at least one longitudinal strips of hydrophilic material, wherein the supplementary element extends in an orthogonal direction with respect to the longitudinal axis of the longitudinal strip of hydrophilic material.

* * * * *